US005826603A

United States Patent [19]

Mellein

[11] Patent Number: 5,826,603

[45] Date of Patent: Oct. 27, 1998

[54] BLIND WASHING DEVICE

[76] Inventor: Robert J. Mellein, 410 Church Rd., #58, Ojai, Calif. 93023

[21] Appl. No.: 704,139

[22] Filed: Aug. 29, 1996

[51] Int. Cl.[6] ..... B08B 3/04; B08B 9/00

[52] U.S. Cl. ..... 134/85; 134/88; 134/91; 134/201

[58] Field of Search ..... 134/84, 85, 88, 134/91, 117, 201, 199; 206/756, 759, 762, 764, 45.24; 211/170, 198; 298/454, 455, 456

[56] References Cited

U.S. PATENT DOCUMENTS 4,561,956 12/1985 Antonelli ..... 134/85
4,618,119 10/1986 Powell ..... 248/456
5,044,036 9/1991 Fujimoto et al. ..... 15/88.1
5,072,478 12/1991 Wagner ..... 15/102

*Primary Examiner*—Jill Warden
*Assistant Examiner*—Paul J. Lee
*Attorney, Agent, or Firm*—Robert M. Sperry

[57] ABSTRACT

An improved blind washing device comprising a frame supporting a plurality of open-ended tubes, closure mechanism for selectably closing said tubes, mechanism for elevating one end of said tubes, a hose connection for delivering water into said tubes, a spray arm, an extensible hose connected to deliver water to said spray arm, an outlet drain and filter mechanism connected between said tubes and said outlet drain.

6 Claims, 1 Drawing Sheet

BLIND WASHING DEVICE

BACKGROUND

1. Field of Invention

This invention relates to washing devices and is particularly directed to improved means for washing vertical blinds and the like.

2. Prior Art

Vertical blinds have been popular for many years for residential and office decor. However, over time, these blinds become dirty and must be cleaned. Unfortunately, it is not possible to wash the blinds in situ, since it is necessary to spray the blinds with appropriate washing and rinsing solutions and this would spatter and drip onto adjacent walls, floors, furniture etc. In the past, the cleaning of vertical blinds has presented a major problem, since it was necessary to dismount the blinds, take them outside, spray them with a washing solution and, subsequently, take them back inside and remount them. This was a messy and labor-intensive operation. Various types of dust brushes have been proposed for removing surface dust and the like from vertical blinds. However, this merely removes surface dirt and, thus, extends the intervals between the necessity for removal and proper washing. Blind washing devices have been proposed, heretofore, to permit washing of the blinds. However, many of the prior art blind washing devices have not been portable and, hence, have required that the blinds be transported to and from the cleaning location. Other blind washing devices have been portable to permit washing the blinds at a location adjacent the mounting location. However, the prior art washing devices have been complex and complicated to use, expensive to produce, have required substantial maintenance and have been generally unsatisfactory.

BRIEF SUMMARY AND OBJECTS OF INVENTION

These disadvantages of the prior art are overcome with the present invention and an improved blind washing device is provided which is portable, is simple and inexpensive to purchase and use and requires virtually no maintenance, yet which provides thorough and complete washing in the vicinity of the mounting location.

The advantages of the present invention are preferably attained by providing an improved blind washing device comprising a frame supporting a plurality of open-ended tubes, closure means for selectably closing said tubes, means for elevating one end of said tubes, a hose connection for delivering water into said tubes, a spray arm, an extensible hose connected to deliver water to said spray arm, an outlet drain and filter means connected between said tubes and said outlet drain.

Accordingly, it is an object of the present invention to provide an improved blind washing device.

Another object of the present invention is to provide an improved blind washing device which is simple and inexpensive to construct and use.

An additional object of the present invention is to provide an improved blind washing device which is portable.

A further object of the present invention is to provide an improved blind washing device which requires virtually no maintenance, yet which provides thorough and complete washing in the vicinity of the mounting location.

A specific object of the present invention is to provide an improved blind washing device comprising a frame supporting a plurality of open-ended tubes, closure means for selectably closing said tubes, means for elevating one end of said tubes, a hose connection for delivering water into said tubes, a spray arm, an extensible hose connected to deliver water to said spray arm, an outlet drain and filter means connected between said tubes and said outlet drain.

These and other objects and features of the present invention will be apparent from the following detailed description, taken with reference to the figures of the accompanying drawing.

DETAILED DESCRIPTION OF THE INVENTION

Figure 1:
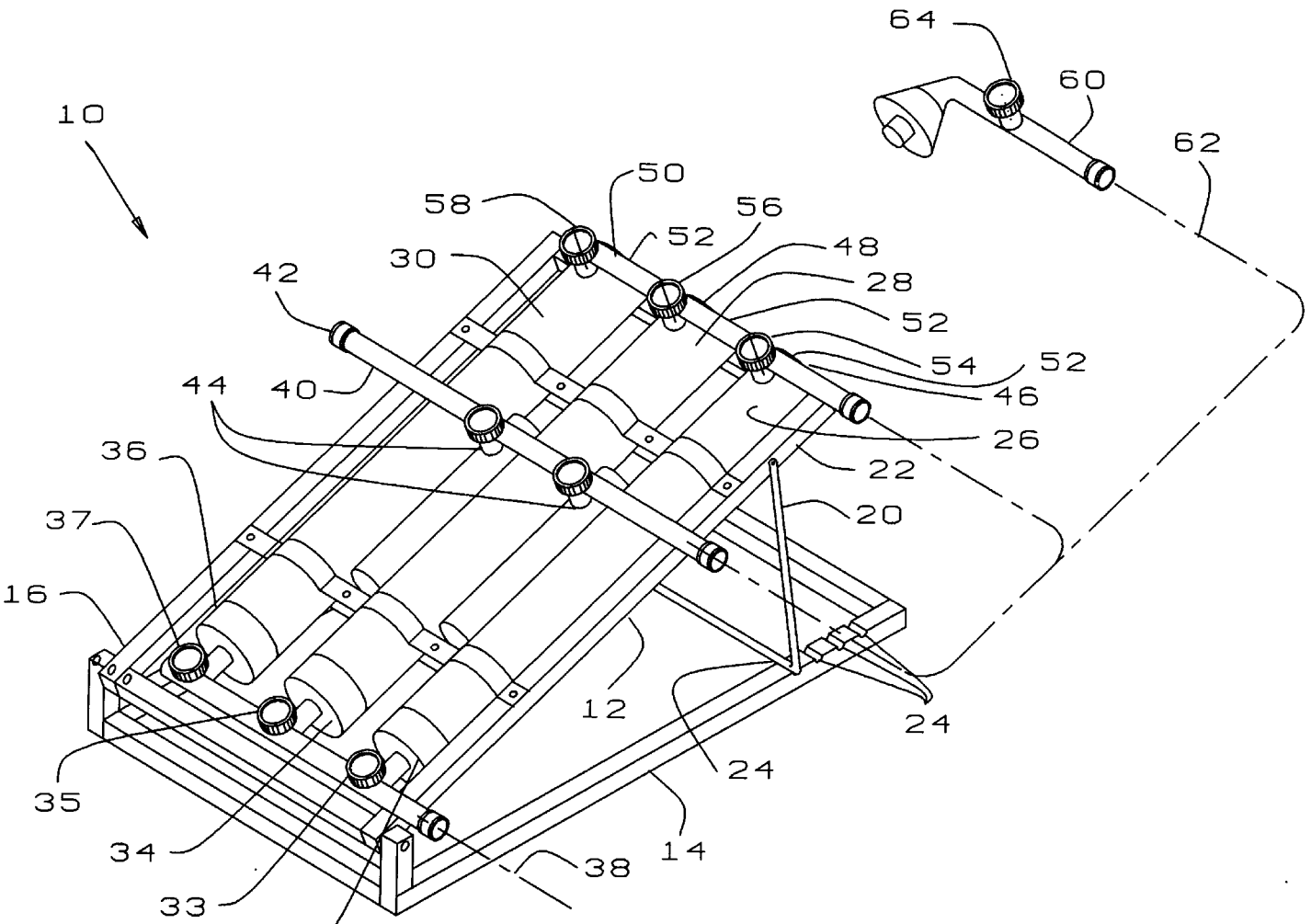
FIG. 1 is an isometric view of a blind washing device embodying the present invention.

In that form of the present invention chosen for purposes of illustration in the drawing, FIG. 1 shows a blind washing device, indicated generally at 10, having a generally rectangular frame 12 having a base member 14 hingedly secured to one end 16 of the frame 12, in FIG. 1, and having a brace member 20 hingedly attached adjacent the opposite end 22 of the frame 12 and engageable with a desired one of a plurality of recesses 24 formed in the base member 14 to releasably retain the frame 12 in a raised position with respect to the base member 14. A plurality of tubes 26, 28 and 30 are mounted on the frame 12 and the lower ends 32, 34 and 36 of the tubes 26, 28 and 30 are closed and are connected by drain valves 33, 35 and 37, to a suitable fluid outlet means, such as drain hose 38, which allows discharge of fluid from within the tubes 26, 28 and 30 to a sewer or other suitable fluid disposal means, not shown. A fluid inlet means, such as inlet hose 40 carries a coupling 42 at one end to releasably connect the blind washing device 10 to a suitable fluid source, not shown, and delivers the fluid through a suitable filter bank 44 and, thence, is connected adjacent the upper ends 46, 48 and 50 of the tubes 26, 28 and 30, respectively, to supply fluid into the tubes 26, 28 and 30, and removable closure means, such as caps 52 serve to releasably seal the upper ends 46, 48 and 50 of the respective tubes 26, 28 and 30. Individual fill valves 54, 56 and 58 are interposed between the inlet hose 40 and the tubes 26, 28 and 30 to regulate the flow of fluid into the respective tubes 26, 28 and 30. Finally, a spray wand 60 is connected by an extendable hose 62 to the output side of the filter bank 44 and has an actuating button 64 to allow selective operation of the spray wand 60.

In use, the blind washing device 10 is set up by raising the frame 12 and swinging the brace member 20 downward into engagement with a desired one of the recesses 24 of the base member 14 to releasably retain end 22 of the frame 12 in the raised position. Thereafter, the closure means 52 are removed from the tubes 26, 28 and 30 and a quantity of a suitable detergent is poured into tube 26. Thereafter, fill valve 54 is opened and hot water is supplied through hose 42 and fill valve 54 into tube 26 to mix with the detergent to form a cleaning solution. Next, a blind to be cleaned is inserted into tube 26 and may be rotated or agitated to ensure that the cleaning solution reaches all parts of the blind. If necessary or desirable, spray arm 60 may be used, by pressing actuator button 64 to spray difficult portions of the blind being cleaned. After the blind has been cleaned, fill valve 56 is opened to allow tube 28 to be filled with rinse water and the newly cleaned blind is removed from tube 26 and inserted into tube 28 to rinse the cleaning solution off of the blind. Meanwhile, a second blind may be inserted into tube 26 for cleaning. After rinsing in tube 28, the blind may be inserted into tube 30 for further rinsing. Alternatively, tube 30 may be filled with a deionizing solution and the blinds, after cleaning and rinsing, may be inserted into the deionizing solution which tends to prevent dust from being attracted to the blinds. When all of the blinds have been washed, rinsed and deionized, drain valves 33, 35 and 37 may be opened to drain the tubes 26, 28 and 30 through the drain hose 38. Finally, the hoses 38 and 42 may be disconnected and brace member 20 may be removed from the recesses 24 to allow the frame 12 to be folded downward against the base member 14 for convenient transportation and storage.

Obviously, if desired, additional tubes, such as tubes 26, 28 and 30 may be provided to permit additional rinses or other treatments. Furthermore, numerous other variations and modifications can obviously be made without departing from the spirit of the present invention. Therefore, it should be clearly understood that the forms of the present invention described above and shown in the accompanying drawing are illustrative only and are not intended to limit the scope of the present invention.

What is claimed is:

1. An improved blind washing device comprising:

a frame, a plurality of open-ended tubes secured to and supported by said frame, closure means for selectably closing said tubes, means for elevating one end of said tubes, a first hose connected to and in fluid communication with each of said plurality of open-ended tubes for selectably delivering fluid into said tubes, and an outlet drain and filter means connected to each of said tubes to drain fluid from said tubes.

2. The blind washing device of claim 1 further comprising:

a spray arm, and an extensible hose connecting said first hose to deliver fluid to said spray arm from said first hose, said spray arm positioned adjacent the open-ends of said tubes to provide fluid to said open-ends.

3. The blind washing device of claim 1 wherein:

said means for raising one end of said tubes include a base member hingedly connected adjacent one end of said frame, and a brace member movable into and out of a position to retain one end of said frame in a raised position.

4. The blind washing device of claim 3 wherein:

said base member is formed with a plurality of recesses and said brace member is releasably insertable into any desired one of said recesses.

5. The blind washing device of claim 1 further comprising:

a plurality of fill valves each interposed between said first hose and a respective one of said tubes.

6. The blind washing device of claim 1 further comprising:

at least one filter member interposed between said first hose and said tubes.

* * * * *